US006424204B2

(12) United States Patent
Gül et al.

(10) Patent No.: US 6,424,204 B2
(45) **Date of Patent: *Jul. 23, 2002**

(54) CURRENT MIRROR CIRCUIT

(75) Inventors: Hasan Gül; Johannes P. A. Frambach, both of Nijmegen (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/858,724

(22) Filed: May 16, 2001

Related U.S. Application Data

(63) Continuation of application No. 09/441,944, filed on Nov. 17, 1999.

(30) Foreign Application Priority Data

Nov. 20, 1998 (EP) ..... 98203917

(51) Int. Cl.[7] ..... G05F 1/10; G05F 3/02

(52) U.S. Cl. ..... 327/538; 327/490; 327/432; 323/315; 323/316; 323/317

(58) Field of Search ..... 323/312, 315, 323/316, 317; 327/530, 538, 103, 427, 478, 489, 490, 542, 543, 432

(56) References Cited

U.S. PATENT DOCUMENTS

| | | | | | |
|---|---|---|---|---|---|
| 4,563,632 | A | * | 1/1986 | Palara et al. | 323/316 |
| 4,574,233 | A | * | 3/1986 | Taylor | 323/316 |
| 5,629,614 | A | * | 5/1997 | Choe et al. | 323/315 |
| 5,666,046 | A | * | 9/1997 | Mietus | 323/313 |
| 6,323,723 | B1 | * | 11/2001 | Gul et al. | 327/538 |

* cited by examiner

*Primary Examiner*—Terry D. Cunningham
*Assistant Examiner*—Long Nguyen
(74) *Attorney, Agent, or Firm*—John Vodopia

(57) ABSTRACT

Current mirror circuit including a current input terminal (2), a current output terminal (6), a common terminal (8), a first transistor (T1) arranged between the current input terminal (2) and the common terminal (8), a second transistor (T2) arranged between the current output terminal (6) and the common terminal (8), a transconductance stage (TS) having an input terminal coupled to the current input terminal (2), and an output terminal coupled to the common terminal (8), and a bias source (22) for biasing the control electrodes of the first and second transistors (T1, T2). This configuration provides a large bandwidth independently of the input current, accurate current transfer and a single pole system.

18 Claims, 3 Drawing Sheets

CURRENT MIRROR CIRCUIT

CROSS REFERENCE TO RELATED APPLICATIONS

This is a continuation of application Ser. No. 09/441,944 filed on Nov. 17, 1999.

BACKGROUND OF THE INVENTION

The invention relates to a current mirror comprising:
a first terminal for receiving an input current;
a second terminal for supplying an output current;
a common terminal;
a first transistor having a control electrode, and having a main current path arranged between the first terminal and the common terminal;
a second transistor having a control electrode connected to the control electrode of the first transistor, and having a main current path arranged between the second terminal and the common terminal.

Such a current mirror is known, for example, from U.S. Pat. No. 4,462,005 and is shown in FIG. 1. In this well-known basic current mirror the interconnected control electrodes, in this case the bases, of the first transistor T1 and the second transistor T2 are connected to the first terminal which forms the current input terminal of the current mirror. The common terminal is connected to a reference terminal, in this case the negative supply terminal which serves as signal ground. As will be explained hereinafter, the bandwidth of this known current mirror strongly depends on the input current due to the presence of an input capacitance $C_i$ between the first terminal and the common terminal and of base-emitter capacitances $C_{be}$ of the first and the second transistor T1 and T2. By adding degeneration resistors in series with the emitters of the first and the second transistor T1 and T2, as shown in FIG. 2, the dependence on the input current can be avoided to some extent. However, this comes at the cost of a reduced bandwidth, an increased input impedance and a smaller voltage swing in comparison with to the basic current mirror of FIG. 1.

It is known to obtain an improvement in bandwidth by adding a gain stage GS as shown in FIG. 3. FIG. 4 shows gain stage formed by means of an emitter follower EF between the first terminal and the interconnected control electrodes of the first and the second transistor T1 and T2. This improved current mirror still has a bandwidth which depends on the input current.

Objects and Summary of the Invention

Therefore, it is an object of the invention to provide a current mirror with improved performance. To obtain the above object, according to the present invention, the current mirror of the type defined in the opening paragraph is characterized in that the current mirror further comprises:

a transconductance stage having an input terminal coupled to the first terminal, and having an output terminal coupled to the common terminal;

and a bias source for biassing the control electrode of the first transistor and the control electrode of the second transistor.

The voltage at the first terminal is sensed by the transconductance stage which drives the common terminal. In this way a feedback loop is created which makes the current through the first transistor equal to the input current, thus providing a low input impedance. The first and the second transistor, assuming that they are bipolar transistors are, in common base configuration and provide a large bandwidth. Advantageous embodiments are defined in the dependent claims.

BRIEF DESCRIPTIONS OF THE DRAWINGS

These and other aspects of the invention will be described and explained with reference to the appended drawings, in which.

In these Figures parts having the same function or purpose are denoted by the same references.

Description of the Preferred Embodiments

Figure 1:
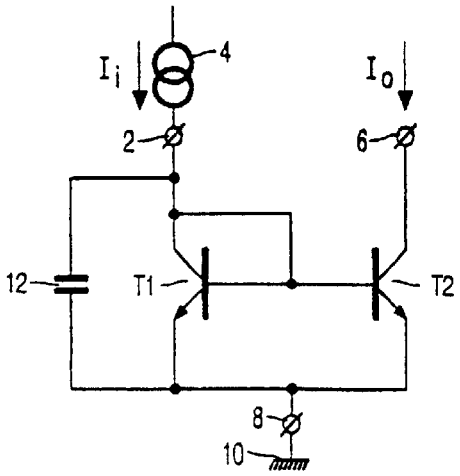
FIG. 1 PRIOR ART
FIG. 1 is a circuit diagram of a known current mirror.

FIG. 1 shows a circuit diagram of the well-known basic current mirror. Bipolar transistors are shown which each have an emitter and a collector which define the main current path of the transistor, and which each have a base which acts as a control electrode for controlling the current through the main current path. The current mirror has a first terminal 2 for receiving an input current $I_i$ from an input current source 4, a second terminal 6 for supplying a mirrored output current $I_o$, and common terminal 8 which is connected to signal ground 10. The main current path of a first transistor T1 is arranged between the first terminal 2 and the common terminal 8, and the main current path of a second transistor T2 is arranged between the second terminal 6 and the common terminal 8. The emitters of the transistors T1 and T2 are connected to the common terminal 8. The bases of the transistor T1 and T2 are interconnected and the interconnected bases are connected to the first terminal 2. The current mirror has an input capacitor 12 between the first terminal 2 and ground 10.

Figure 2:
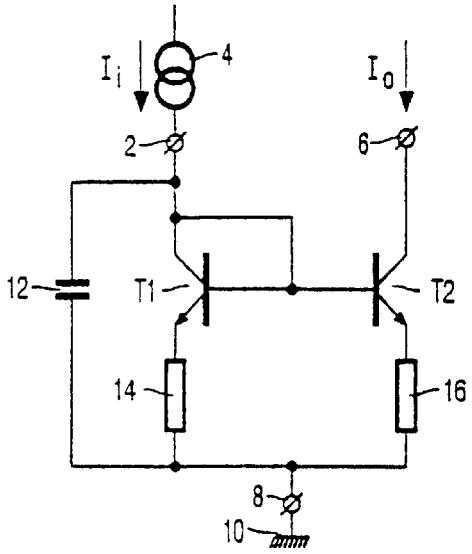
FIG. 2 PRIOR ART
FIG. 2 is a circuit diagram of a known current mirror.

The DC current transfer characteristic of the current mirror is:

$$I_o = I_i\left(1 - \frac{2}{\beta + 2}\right) \tag{1}$$

where β is the current gain of the transistors T1 and T2. The bandwidth fh of this current mirror strongly depends on the input current $I_i$, and can be calculated with the following equation (2):

$$fh = \frac{g_m}{2\pi \cdot (C_i + 2C_{be})} = \frac{I_1}{2\pi \cdot (C_i + 2C_{be}) \cdot V_T} \tag{2}$$

where $g_m = I_i/V_Y$ is the small signal transconductance of the transistor T1, $C_1$ the capacitance of input capacitor 12, $C_{be}$ the base-emitter capacitance of the transistors T1 and T2 and $V_Y$ the thermal voltage of a bipolar transistor. From equation 2 it is apparent that the bandwidth fh is directly proportional to the input current $I_i$. This dependence can be reduced by applying emitter degeneration as shown in FIG. 2. Degeneration resistors 14 and 16 are arranged in the emitter leads of the transistors T1 and T2, respectively. The bandwidth fh for this configuration can be calculated with the following equation:

$$fh = \frac{1}{2\pi \cdot (C_i + 2C_{be}) \cdot (R_e + r_e)} = \frac{1}{2\pi \cdot (C_i + 2C_{be}) \cdot \left(R_e + \frac{V_T}{I_i}\right)} \quad (3)$$

where $\Gamma_e = 1/g_m$ of the transistor T1, and $R_e$ the resistance of the degeneration resistor 14. If $R_e >> \Gamma_e$, the bandwidth fh is mainly determined by the values of the capacitors and the degeneration resistor. The reduced input current dependence comes at the cost of a smaller bandwidth, an increased input impedance and a smaller voltage swing in comparison with the basic current mirror of FIG. 1.

Figure 3:
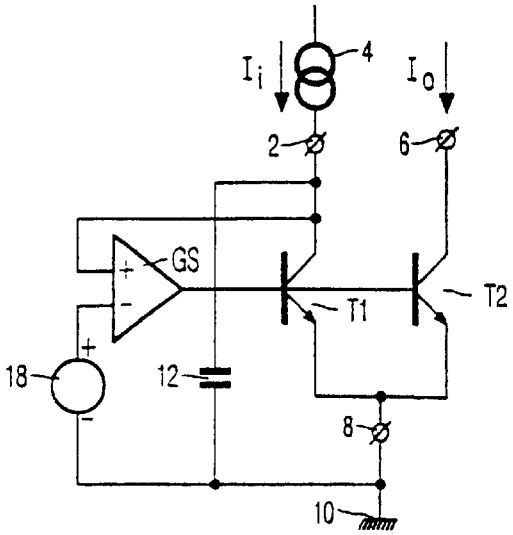
FIG. 3 PRIOR ART
FIG. 3 is a circuit diagram of a known current mirror.

FIG. 3 shows a known improved current mirror. The direct connection between the first terminal 2 and the interconnected bases is replaced with a gain stage GS, which has a non-inverting input connected to the first terminal 2, an inverting input connected to a reference voltage source 18 and an output connected to the interconnected bases. The input impedance $\Gamma_i$ of this current mirror is given by:

$$r_i = \frac{1}{A \cdot g_{ml}} = \frac{1}{A} \cdot \frac{V_T}{I_i} \quad (4)$$

where A is the gain of the gain stage GS and $g_{ml}$ the transconductance of the transistor T1. The input impedance $\Gamma_i$ together with the capacitance $C_1$ of the input capacitor 12 form a pole which determines the bandwidth fh of the current mirror, and is given by:

$$fh = \frac{1}{2\pi \cdot C_i \cdot r_i} = \frac{A \cdot I_i}{2\pi \cdot C_i \cdot V_T} \quad (5)$$

Compared with the bandwidth of the basic current mirror in equation 2, the bandwidth fh has increased owing to the gain A and the missing capacitance $C_{be}$, but is still proportional to the input current $I_1$. Again, emitter degeneration can be applied just as in the basic current mirror at the same cost of bandwidth, input impedance and voltage swing.

Figure 4:
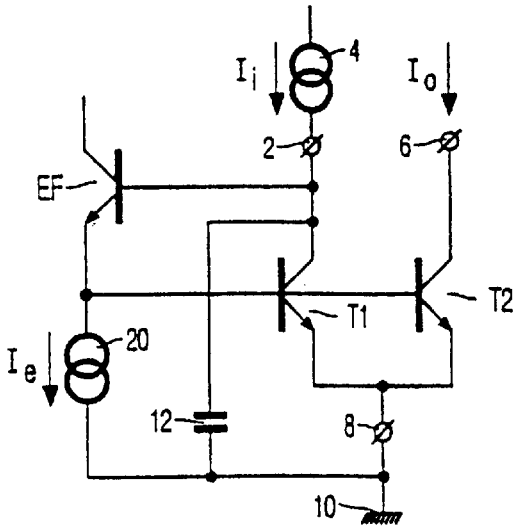
FIG. 4 PRIOR ART
FIG. 4 is a circuit diagram of a known current mirror.

FIG. 4 shows a version of the current mirror of FIG. 3 in which the gain stage is an emitter follower transistor EF which has its base connected to the first terminal 2, its emitter connected to the interconnected bases of the transistors T1 and T2 and to a bias current source 20. Owing to the high gain A the DC transfer characteristic of the current mirror of FIG. 3 is:

$$I_o = I_i \quad (5a)$$

while the DC current gain of the current mirror of FIG. 4 is given by:

$$I_o = \left(I_i - \frac{I_e}{\beta + 1}\right) \cdot \left(1 - \frac{2}{\beta^2 + 1}\right) \quad (5b)$$

where $I_e$ is the current of bias current source 20.

Figure 5:
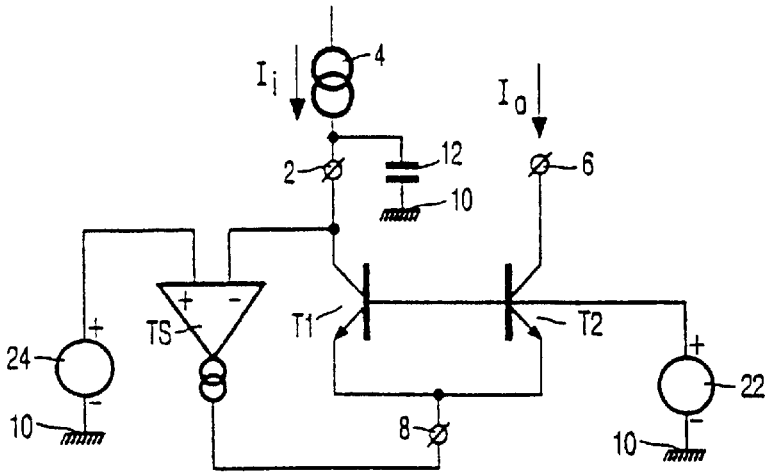
FIG. 5 is a circuit diagram of a first embodiment of a current mirror in accordance with the invention.

FIG. 5 shows a current mirror in accordance with the invention. The interconnected bases of the transistors T1 and T2 are biased by a bias source 22. The current mirror further has a transconductance stage TS which has an inverting input coupled to the first terminal 2, a non-inverting input to a bias source 24 and a current output to the common terminal 8. The voltage at the first terminal 2 is sensed by the transconductance stage TS, which drives the emitter of transistor T1. The feedback loop thus formed adjusts the current through transistor T1 until it is equal to the input current $I_i$. The current through transistor T1 is copied to the second terminal 6 by the transistor T2. The DC current transfer characteristic of this arrangement therefore is the same as given in equation 5a. The transistors T1 and T2 are operated in common-base configuration and thus have a large bandwidth. Assuming that the transconductance stage TS also has a large bandwidth, which is generally the case, the dominant pole is located at the first input terminal 2 of the current mirror. As a result, this configuration offers the advantageous possibility of a single pole design.

The input resistance $\Gamma_1$ of the FIG. 5 current mirror is given by:

$$r_i = \frac{2}{g_m} \quad (6)$$

where $g_m$ is the transconductance of the transconductance stage TS. The factor 2 in the equation 6 is due to the fact that the output current of the transconductance stage TS is halved by the transistors T1 and T2. The input resistance $\Gamma_1$ and the input capacitance $C_1$ form a pole which dictates the bandwidth fh of the FIG. 5 current mirror. This bandwidth is given by:

$$fh = \frac{1}{2\pi \cdot C_i \cdot r_i} = \frac{g_m/2}{2\pi \cdot C_i} \quad (7)$$

If the transconductance $g_m$ is independent of the input current $I_i$, the bandwidth fh is also independent of the input current.

Figure 6:
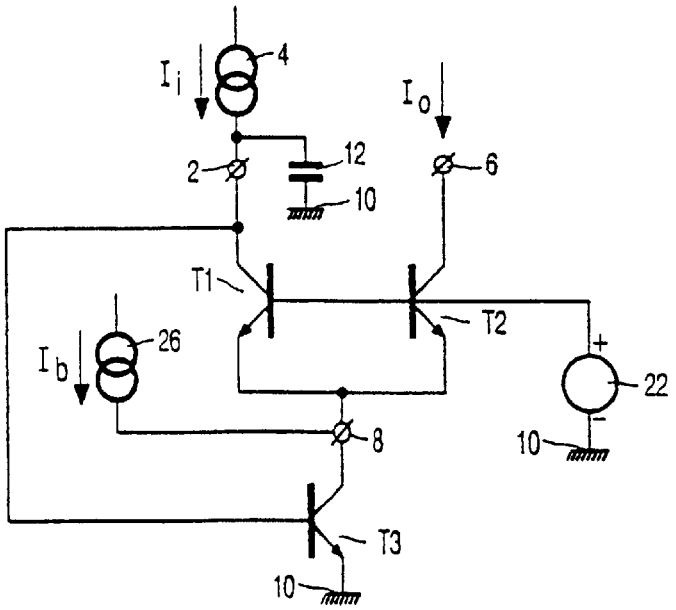
FIG. 6 is a circuit diagram of a second embodiment of a current mirror in accordance with the invention.

FIG. 6 shows an example of the transconductance stage TS with a transistor T3, which has its base coupled to the first terminal 2, its collector coupled to the common terminal 8 and its emitter coupled to ground 10. A bias current source 26 is also coupled to the common terminal 8 to provide a bias current $I_b$. The transconductance $g_m$ of the transistor T3 is made independent of the input current $I_1$ by adding the bias current $I_b$ to the collector of transistor T3. In that case the transconductance $g_m$ of the transistor T3 is given by:

$$g_m = \frac{I_b + 2I_i}{V_T} \quad (8)$$

By making the bias current $I_b$ much larger than the input current $I_i$ the input impedance will not change significantly with the input current $I_1$. It is to be noted that the extra bias current $I_b$ does not flow through the actual current mirror T1–T2 and does not affect the output current $I_o$. In other words, the current mirror transfer characteristic and the input impedance can be optimized independently of each other. Because the input impedance, together with the input capacitor 12, determines the bandwidth, the bandwidth is also insensitive to the input current variations and can be optimized separately. The DC current transfer characteristic of the FIG. 6 current mirror is given by:

$$I_0 = \left(I_i - \frac{I_b}{\beta}\right) \cdot \left(1 - \frac{2}{\beta} - \frac{2}{\beta^2}\right) \quad (9)$$

Figure 7:
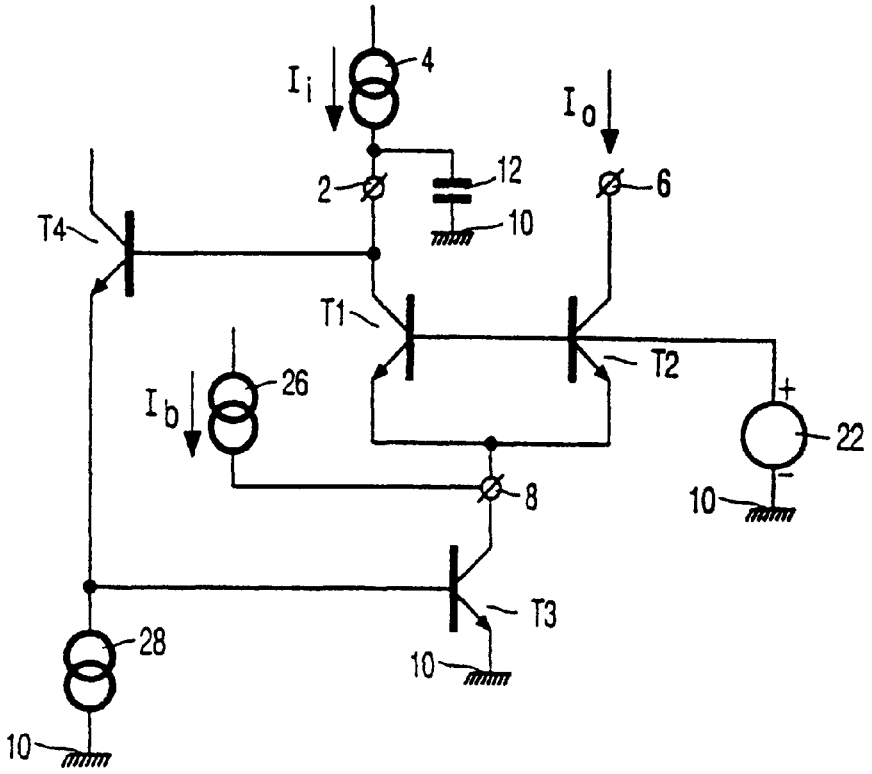
FIG. 7 is a circuit diagram of a third embodiment of a current mirror in accordance with the invention.
Figure 8:
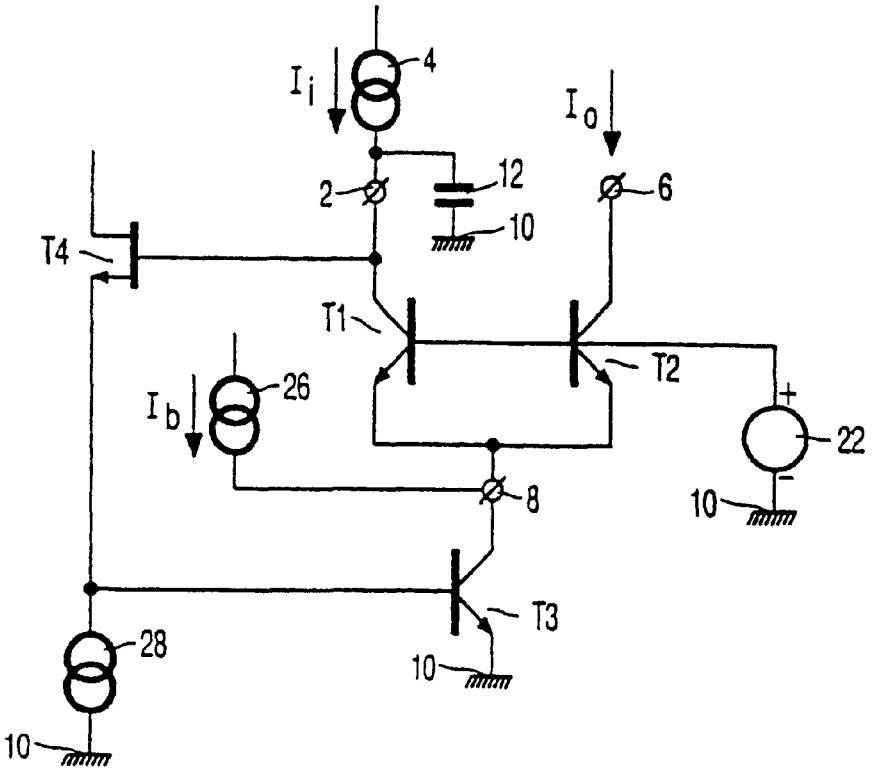
FIG. 8 is a circuit diagram of a fourth embodiment of a current mirror in accordance with the invention.

Instead of directly coupling the base of the transistor T3 to the first terminal 2, an emitter follower transistor T4 can be placed between them as shown in FIG. 7. The base of the transistor T4 is coupled to the first terminal 2 and the emitter of the transistor T4 drives the base of the transistor T3. A bias current source 28 supplies bias current to the emitter of transistor T4. This configuration with the emitter follower transistor T4 provides a larger voltage swing at the first terminal 2 within the mirror circuit itself at the cost of a higher DC input voltage level. FIG. 8 shows an alternative configuration in which transistor T4 is a MOSFET, which has the advantage that no current is drawn from the first terminal 2, resulting in a nearly perfect current mirror configuration with a 1 to 1 ratio between input current $I_i$ and output current $I_o$ (assuming equal transistors T1 and T2).

In the embodiments mainly bipolar transistors are shown. However, instead of bipolar transistors unipolar or MOSFET transistors can be used. In that case the gate, source and drain of the unipolar transistor substitute respectively the base, emitter and collector, of the bipolar transistor. Multiple outputs are possible by providing copies of the transistor T2 between the common terminal 8 and additional second terminals 6.

What is claimed is:

1. A current mirror comprising:

a first terminal for receiving an input current;

a second terminal for supplying an output current;

a common terminal;

a first transistor having:

a control electrode, and having a main current path arranged between the first terminal and the common terminal;

a second transistor having:

a control electrode connected to the control electrode of the first transistor, and a main current path arranged between the second terminal and the common terminal, a transconductance stage having:

an input terminal coupled to the first terminal, and an output terminal coupled to the common terminal; and a bias source for biasing the control electrode of the first transistor and the control electrode of the second transistor, and a third transistor having a control electrode coupled to the first terminal, and a main current path coupled between the common terminal and a reference terminal.

2. A current mirror as claimed in claim 1, further comprising a buffer stage arranged between the first terminal and the control terminal of the third transistor.

3. A current mirror as claimed in claim 2, wherein the buffer stage comprises a fourth transistor operating as a voltage follower, the fourth transistor having a control electrode coupled to the first terminal, and having main electrode coupled to the control electrode of the third transistor.

4. A current mirror as claimed in claim 3, wherein the first, second and the third transistor are bipolar transistors and the fourth transistor is a MOSFET transistor.

5. A current mirror as claimed in claim 4, further comprising a bias current source coupled to the common terminal to supply bias current to the common terminal.

6. A current mirror as claim in claim 3, further comprising a bias current source coupled to the common terminal to supply bias current to the common terminal.

7. A current mirror as claim in claim 2, further comprising a bias current source coupled to the common terminal to supply bias current to the common terminal.

8. A current mirror as claim in claim 1, further comprising a bias current source coupled to the common terminal to supply bias current to the common terminal.

9. A current mirror circuit comprising:

a first terminal;

a second terminal;

a common terminal;

a first transistor including a control electrode and being operatively coupled to the first terminal and the common terminal;

a second transistor including a control electrode and being operatively coupled to the second terminal and the common terminal; and a transconductance stage comprising a third transistor including a control electrode operatively coupled to the first terminal, and a main current path operatively coupled between the common terminal and a reference terminal.

10. A current mirror as claimed in claim 9, wherein the transconductance stage further comprises an input terminal coupled to the first terminal, an output terminal coupled to the common terminal, and a bias source for biasing the control electrode of the first transistor and the control electrode of the second transistor.

11. A current mirror as claimed in claim 9, further comprising a buffer stage arranged between the first terminal and the control terminal of the third transistor.

12. A current mirror as claimed in claim 11, wherein the buffer stage comprises a fourth transistor operating as a voltage follower, the fourth transistor having a control electrode coupled to the first terminal, and having a main electrode coupled to the control electrode of the third transistor.

13. A current mirror as claimed in claim 12, wherein the first, second, and the third transistor are bipolar transistors and the fourth transistor is a MOSFET transistor.

14. A current mirror as claimed in claim 13, further comprising a bias current source coupled to the common terminal to supply bias current to the common terminal.

15. A current mirror as claimed in claim 12, further comprising a bias current source coupled to the common terminal to supply bias current to the common terminal.

16. A current mirror as claimed in claim 11, further comprising a bias current source coupled to the common terminal to supply bias current to the common terminal.

17. A current mirror as claimed in claim 10, further comprising a bias current source coupled to the common terminal to supply bias current to the common terminal.

18. A current mirror as claimed in claim 9, further comprising a bias current source coupled to the common terminal to supply bias current to the common terminal.

* * * * *